US009126443B2

(12) United States Patent
Shikama

(10) Patent No.: US 9,126,443 B2
(45) Date of Patent: Sep. 8, 2015

(54) LIQUID JETTING APPARATUS

(71) Applicant: BROTHER KOGYO KABUSHIKI KAISHA, Nagoya-shi, Aichi-ken (JP)

(72) Inventor: Yasuhito Shikama, Yokkaichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 52 days.

(21) Appl. No.: 13/851,900

(22) Filed: Mar. 27, 2013

(65) Prior Publication Data

US 2013/0276561 A1 Oct. 24, 2013

(30) Foreign Application Priority Data

Apr. 19, 2012 (JP) ..... 2012-095790

(51) Int. Cl.
*B41J 23/14* (2006.01)
*B41J 19/00* (2006.01)

(52) U.S. Cl.
CPC ..... *B41J 23/14* (2013.01); *B41J 19/005* (2013.01); *Y10T 74/18848* (2015.01)

(58) Field of Classification Search
CPC ..... B41J 2/1752; B41J 25/001
USPC ..... 239/140
See application file for complete search history.

(56) References Cited

U.S. PATENT DOCUMENTS

| | | | | |
|---|---|---|---|---|
| 7,758,460 | B2 * | 7/2010 | Osakabe et al. | 474/117 |
| 7,837,401 | B2 * | 11/2010 | Sugiura | 400/354 |
| 7,878,322 | B2 * | 2/2011 | Kawamata | 198/813 |
| 8,057,339 | B2 * | 11/2011 | Sugiura | 474/198 |
| 8,608,282 | B2 * | 12/2013 | Terada | 347/37 |
| 2006/0120758 | A1 | 6/2006 | Muto | |
| 2013/0161412 | A1 | 6/2013 | Kawagoe et al. | |

FOREIGN PATENT DOCUMENTS

| | | | |
|---|---|---|---|
| JP | 2000-037921 | A | 2/2000 |
| JP | 2006-021423 | A | 1/2006 |
| JP | 2006-162961 | A | 6/2006 |
| JP | 2007-144675 | A | 6/2007 |
| JP | 2008-296474 | A | 12/2008 |
| JP | 2013-152016 | A | 8/2013 |

* cited by examiner

*Primary Examiner* — Stephen Meier
*Assistant Examiner* — Renee I Wilson
(74) *Attorney, Agent, or Firm* — Merchant & Gould PC

(57) ABSTRACT

A liquid jetting apparatus includes: a liquid jetting head; a carriage which carries the liquid jetting head and moves in a scanning direction; a plurality of pulleys arranged on a first plane, each having an axis extending perpendicular to the first plane, and including at least a first pulley and a second pulley separated from the first pulley in the scanning direction; an endless belt put around the plurality of pulleys to make contact with a circumference of each of the first and second pulleys and connected to the carriage; a pulley holder having a fixing portion, holding a tension adjusting pulley which adjusts a tension applied to the belt, being movable along the first plane together with the tension adjusting pulley; two plates sandwiching the fixing portion of the pulley holder; and a fastening member which fixes the fixing portion to the two plates.

13 Claims, 9 Drawing Sheets

LIQUID JETTING APPARATUS

CROSS REFERENCE TO RELATED APPLICATION

The present application claims priority from Japanese Patent Application No. 2012-095790, filed on Apr. 19, 2012, the disclosure of which is incorporated herein by reference in its entirety.

BACKGROUND OF THE INVENTION

1. Field of the Invention

The present invention relates to a liquid jetting apparatus which jets a liquid from nozzles.

2. Description of the Related Art

As a liquid jetting apparatus which jets a liquid from nozzles, Japanese Patent Application laid-open No. 2006-21423 describes an image forming apparatus which jets an ink from the nozzles to perform printing. In the image forming apparatus described in Japanese Patent Application laid-open No. 2006-21423, a belt is wound and applied between two pulleys which are aligned in a scanning direction with a spacing distance therebetween, and a carriage which carries an ink jethead is connected to a portion of the belt positioned between the two pulleys. In this structure, in a case that the belt is driven to travel by rotating the pulleys, the carriage is moved in the scanning direction. In this situation, the carriage is guided along a sliding surface provided in a plate (support plate). One of the two pulleys is provided in the plate, and the other pulley is held by a pulley holder (holder) which is movable with respect to the plate in the scanning direction. The pulley holder is biased or urged by a spring toward a direction in which the other pulley is pressed to the belt. Accordingly, tension depending on biasing force of the spring is applied to the belt.

In the image forming apparatus described in Japanese Patent Application laid-open No. 2006-21423, the tension of the belt is temporarily changed at the time of moving the carriage. In this situation, since the pulley holder is not fixed to the plate, the pulley holder is moved in the scanning direction (so-called autotension) so that the tension of the belt and the biasing force of the spring are balanced in the scanning direction. Thus, in a case that tension originally applied to the belt is small, there is fear that a moving amount of the holder is large to make the belt loose, which causes difficulty in the travel of the belt.

In a case that the biasing force of the spring is made to be larger to make the tension applied to the belt larger, the situation, in which the belt is loosen to have difficulty in traveling, is not occurred. In this case, however, burden on a motor rotating the pulleys to move the carriage is increased. Therefore, it is required to use a large motor, which increases the size of the apparatus.

In view of the above, the inventor of the present teaching has considered to adopt a type (so-called fixed tension) in which the pulley holder is fixed to the plate by a bolt and the like at a position at which force received from the spring and force received from the belt are balanced in the scanning direction, in the image forming apparatus described in Japanese Patent Application laid-open No. 2006-21423. In this case, even when the tension of the belt is changed by moving the carriage, the pulley holder is not moved. Thus, even when the tension of the belt is small, the travel of the belt is less likely to be affected.

In this case, however, in a case that the position of the pulley holder is deviated in a direction, which is parallel to a plane perpendicular to a stacking direction of the pulley holder and the plate, at the time of fixing the pulley holder to the plate, even though the deviation is not so large (for example, about 0.5 mm), the tension applied to the belt is changed significantly.

An object of the present teaching is to provide a liquid jetting apparatus which is capable of applying a predetermined tension to a belt reliably in a case that a so-called fixed tension is adopted in order to apply the predetermined tension to the belt which is wound and applied between pulleys to move a carriage.

SUMMARY OF THE INVENTION

According to an aspect of the present teaching, there is provided a liquid jetting apparatus configured to jet a liquid, including: a liquid jetting head configured to jet the liquid; a carriage configured to carry the liquid jetting head and to move in a predetermined scanning direction; a plurality of pulleys arranged on a predetermined first plane parallel to the scanning direction, each having an axis extending perpendicular to the first plane, and including at least a first pulley and a second pulley which is arranged to be separated from the first pulley in the scanning direction such that at least one of two external common tangents with the first pulley and the second pulley is parallel to the scanning direction; an endless belt put around the plurality of pulleys to make contact with a circumference of each of the first pulley and the second pulley, and connected to the carriage at a portion of the endless belt positioned on the external common tangent parallel to the scanning direction, which is one of the two external common tangents with the first pulley and the second pulley; a pulley holder having a fixing portion, holding a tension adjusting pulley which is included in the plurality of pulleys and which adjusts a tension applied to the belt, and configured to be movable along the first plane together with the tension adjusting pulley; two plates configured to sandwich the fixing portion therebetween; and a fastening member configured to fix the fixing portion to the two plates, wherein the two plates are configured not to move relative to each other in a direction parallel to a second plane which is perpendicular to a stacking direction of the two plates and the fixing portion; and the fixing portion is fixed to the two plates in a state that the pulley holder is arranged at a position at which a predetermined tension is applied to the belt.

In a case that the fixing portion of the pulley holder is fixed to one plate by the fastening member, the force acts from the fastening member to the fixing portion in a direction parallel to the second plane. The pulley holder is shifted in the second plane by this force, and thereby shifting the position of the tension adjusting pulley. Alternately, in a case that the fixing portion of the pulley holder is fixed to one plate by the fastening member, the force is locally applied to the fixing portion from the fastening member to form the recess. Therefore, in a case that, for example, the position of the pulley holder is readjusted, the following problem may arise. That is, in a case that the fixing by the fastening member is released and further that the fixing by the fastening member is performed again, the fastening member is guided to the position at which the fastening member was once positioned due to the recess, and thereby the pulley holder is shifted in the second plane due to the force, which is received from the fastening member at the time of performing the fixing.

In the present teaching, since the pulley holder is sandwiched between the two plates, the force in the direction parallel to the second plane does not act from the fastening member to the fixing portion, and only the force in the direction perpendicular to the second plane acts. Further, in a case that the fixing portion is fixed to two plates by the fastening member, the recess as described above is not formed in the fixing portion. Thus, it is possible to prevent the position shift of the pulley holder at the time of the fixing as described above. As a result, it is possible to prevent change of the tension applied from the belt due to the position shift of the tension adjusting pulley at the time of fixing the pulley holder, and thereby making it possible to apply a predetermined tension to the belt reliably.

DESCRIPTION OF THE PREFERRED EMBODIMENTS

An exemplary embodiment of the present teaching will be described below. In the following description, a right side and a left side in a scanning direction are defined as shown in FIG. 1, and a direction perpendicular to a paper surface of FIG. 1 is defined as a vertical direction (up-down direction).

Figure 1:
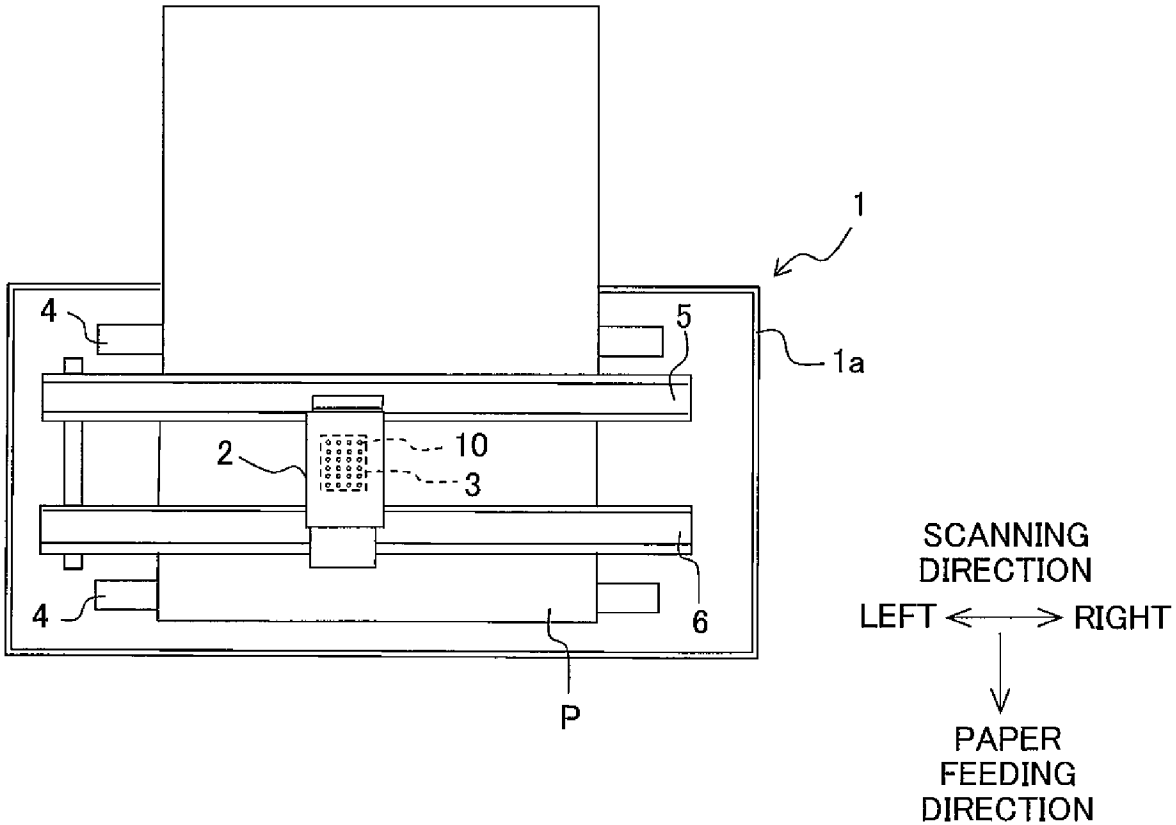
FIG. 1 is a schematic structural diagram of a printer according to an embodiment of the present teaching.

As shown in FIG. 1, a printer 1 according to the embodiment includes a carriage 2, an ink-jet head 3, a paper transport roller 4 and the like. The carriage 2 is configured to be movable in the scanning direction (an example of the first direction) along two guide rails 5 and 6 provided to a printer body 1*a*, and reciprocates in the scanning direction when a moving mechanism 11 which will be described later is driven. The ink-jet head 3 is mounted on a portion, of the carriage 2, positioned between the guide rail 5 and the guide rail 6, and is configured to jet an ink from a plurality of nozzles 10 formed in the lower surface of the ink-jet head 3. The paper transport roller 4 transports a recording paper sheet P in a paper feeding direction (an example of the second direction) which is orthogonal to the scanning direction.

In the printer 1, printing is carried out on the recording paper sheet P, which is transported in the paper feeding direction by the paper transport roller 4, by jetting the ink from the ink-jet head 3 reciprocating in the scanning direction together with the carriage 2. The recording paper sheet P having printing carried out thereon is discharged by the paper transport roller 4.

Figure 7A:
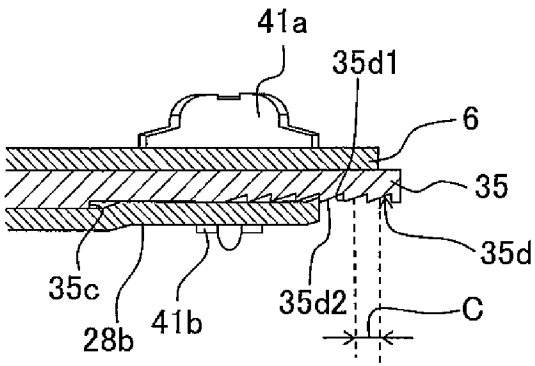
FIG. 7A is a cross-sectional view taken along a line VIIA-VIIA of FIG. 4.
Figure 7B:
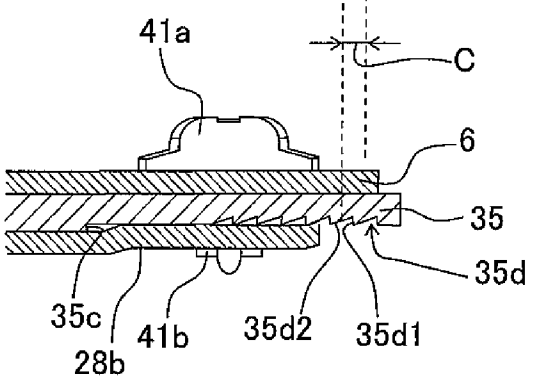
FIG. 7B is a cross-sectional view taken along a line VIIB-VIIB of FIG. 4.
Figure 8:
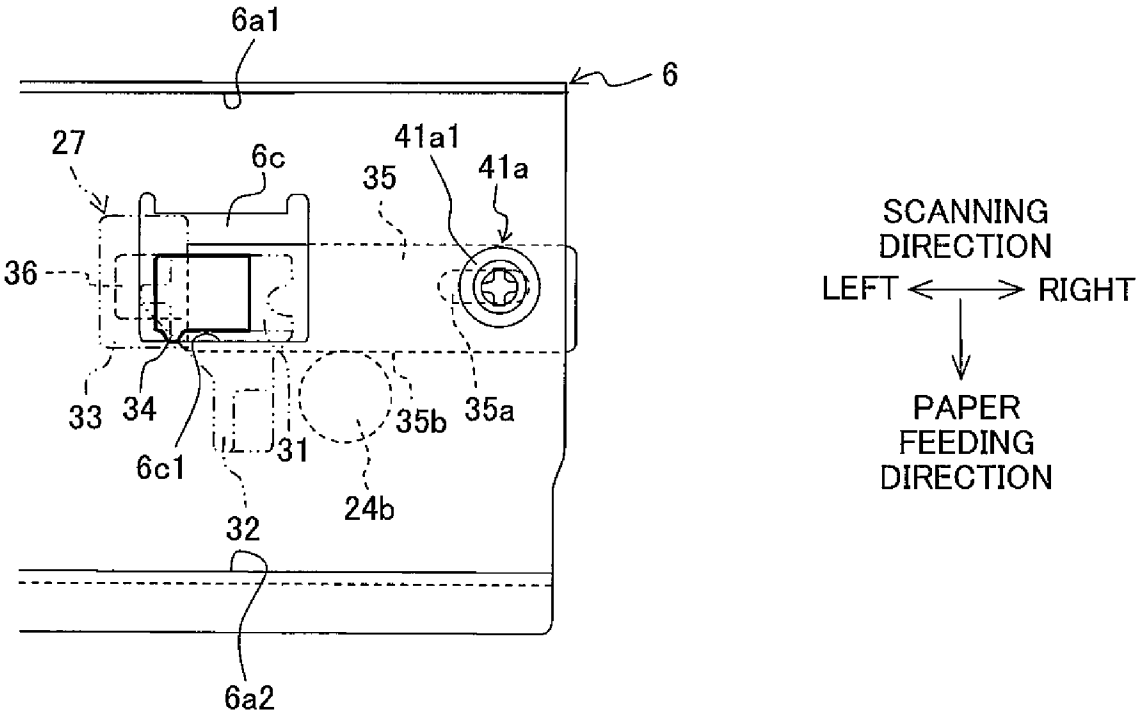
FIG. 8 is a diagram showing a positional relation of a pulley holder in a plan view and a hole of a frame to which the pulley holder is fixed.

Next, structures of the carriage 2, the guiderails 5 and 6, the moving mechanism 11 which moves the carriage 2, and the like will be described in detail with reference to FIG. 2 to FIG. 8. In FIG. 8, a portion of a pulley holder 27, which will be described later, which is positioned on the upper side of the guide rail 6 is indicated by two-dot lines, a portion of the pulley holder 27 which is positioned on the lower side of the guide rail 6 is indicated by dashed lines, and a portion of the pulley holder 27 which is positioned in a through hole 6*c* of the guide rail 6 is indicated by a thick line. Further, a part of the portion of the pulley holder 27 to be indicated by the dashed lines is omitted.

The scanning direction and the paper feeding direction of the guide rails 5 and 6 correspond to a plane direction of the guide rails 5 and 6. Plates, each of which is made of a metallic material and has a substantially rectangular shape extending in the scanning direction as a longitudinal direction, are bent at both end portions in the paper feeding direction to form the guide rails 5 and 6, respectively. Two explain more elaborately, two ends in the paper feeding direction of the guide rail 5 are bent upward, and furthermore, a portion at the outer side of the bent portion is bent outward in the paper feeding direction. The upstream end portion of the carriage 2 in the paper feeding direction is supported from below by the guide rail 5 at a substantially central portion in the paper feeding direction.

Whereas, the upstream end portion of the guide rail 6 (first plate) in the paper feeding direction is bent upward, and also, the downstream end portion of the guide rail 6 in the paper feeding direction is bent upward. Further, a portion of the guide rail 6 at the outer side of the bent portion is bent outward in the paper feeding direction. Furthermore, the guide rail 6 supports, from a lower side, the downstream end portion of the carriage 2 in the paper feeding direction. A downstream surface in the paper feeding direction of the upstream end portion of the guide rail 6 in the paper feeding direction which is extended in the vertical direction by being bent, functions as a sliding surface 6*a*1 which is extended in the scanning direction, and an upstream surface in the paper feeding direction of the downstream end portion of the guide rail 6 in the paper feeding direction which is extended in the vertical direction by being bent, functions as a sliding surface 6*a*2 which is extended in the scanning direction.

The carriage 2 is arranged to make contact with the sliding surfaces 6*a*1 and 6*a*2, and is movable in the scanning direction by sliding on the sliding surfaces 6*a*1 and 6*a*2.

The moving mechanism 11 includes three pulleys 21, 22, and 23, a motor 24, a belt 25, a tension pulley 26, the pulley holder 27, and the like.

The pulley 21 (first pulley) is arranged at the right end portion on the upper surface (first plane) of the guide rail 6. The pulley 22 (second pulley) is arranged at the left end portion on the upper surface of the guide rail 6. In other words, the pulley 21 and the pulley 22 are arranged to be separated mutually in the scanning direction. The pulley 21 and the pulley 22 are positioned at the same position with respect to the paper feeding direction, and an external common tangent L1 of the pulley 21 and the pulley 22 is parallel to the scanning direction.

The pulley 23 (a third pulley) is a pulley having a plurality of teeth along a circumferential direction thereof, and is arranged on the upper surface of the guide rail 6 at a position shifted to the downstream side in the paper feeding direction from the pulley 21. Accordingly, the pulley 23 is arranged at a position at which an external common tangent L2 with the pulley 21 intersects the scanning direction. The motor 24 is arranged at the lower side of the guide rail 6, and a shaft 24*a* of the motor 24 is directly coupled with the pulley 23. Here, the motor 24 which is arranged at the lower side of the guide rail 6 is coupled with the pulley 23 so that the shaft 24*a* is drawn up to the upper side of the guide rail 6 through a through hole 6*b* formed in a portion of the guide rail 6 facing the pulley 23.

The belt 25 is an endless belt, and is put around the pulleys 21 to 23 to make contact with a circumference of each of the pulley 21 to 23. A belt grip 2*a* which is provided to the carriage 2 is fixed to a portion 25*a* of the belt 25 put around the pulleys 21 to 23, which is positioned on the external common tangent L1 of the pulley 21 and the pulley 22. Accordingly, the carriage 2 is fixed to the belt 25.

The belt 25 is a timing belt and a plurality of teeth, which are not shown in the diagram, is formed along an inner peripheral surface of the belt 25. The teeth of the belt 25 are engaged with the teeth of the pulley 23. Accordingly, when the pulley 23 is rotated by driving the motor 24, the belt 25 rotates, and at this time, the pulleys 21 and 22 rotate together with the belt 25 due to force of friction with the belt 25. As the belt 25 rotates, the portion 25*a* moves in the scanning direction, and accordingly, the carriage 2 which is fixed to the portion 25*a* moves in the scanning direction.

The tension pulley 26 (tension adjusting pulley, fourth pulley) is arranged on the upper surface of the guide rail 6, at the immediate left side of the pulleys 21 and 23 in the scanning direction, at a position between the pulley 21 and the pulley 23 in the paper feeding direction. The tension pulley 26 makes contact with a contact portion 25*b*1 of the belt 25 which is positioned on a surface on the outer side of a portion 25*b* between the pulley 22 and the pulley 23, and thereby the portion 25*b* of the belt 25 is bent. Accordingly, the contact portion 25*b*1 is positioned at the inner side of an external common tangent L3 of the pulley 22 and the pulley 23. Moreover, a portion 25*b*2, of the portion 25*b* of the belt 25 which is bent, positioned between the contact portion 25*b*1 and the pulley 22 is substantially parallel to the scanning direction, and a portion 25*b*3, of the portion 25*b* of the belt 25 which is bent, positioned between the contact portion 25*b*1 and the pulley 23 is substantially parallel to the paper feeding direction.

The pulley holder 27 is made of a material which is hardly deformed in the up-down direction such as a synthetic resin material mixed with a glass fiber, and is arranged so that the pulley holder 27 is passed through the substantially rectangular through hole 6*c* formed in the guide rail 6 and is spread across the upper side and the lower side of the guide rail 6. A pulley holding portion 31 is provided to a portion of the pulley holder 27, which is positioned at the upper side of the guide rail 6 (a portion indicated by an alternate long and two short dashes line in FIG. 8) and which faces the through hole 6*b*. A shaft 26*a* which supports the tension pulley 26 is fixed to the pulley holding portion 31, and accordingly, the tension pulley 26 is supported by the pulley holding portion 31.

Further, a portion of the pulley holder 27, which is positioned at the upper side of the guide rail 6, is provided with an arm 32. The arm 32 is extended up to a position which does not face the through hole 6*b* on the downstream side of the pulley holding portion 31 in the paper feeding direction. Furthermore, a portion 33 which is extended up to a position which does not face the through hole 6*b* is provided on the left side of the pulley holding portion 31.

A protrusion (a projection) 34 which is protruded toward the downstream side in the paper feeding direction is provided at an end of the downstream side in the paper feeding direction, of a portion of the pulley holder 27, which is positioned inside the through hole 6*c* (portion indicated by a thick line in FIG. 8). The protrusion 34 makes contact with a wall surface 6*c*1 of the through hole 6*c* on the downstream side in the paper feeding direction. The wall surface 6*c*1 is extended in the scanning direction.

A portion of the pulley holder 27 which is positioned at the lower side of the guide rail 6 is extended continuously to be spreading across left-right of the through hole 6*c* with respect to the scanning direction. A fixing portion 35, which is positioned on the right side of the through hole 6*c*, has a right end portion protruding toward the right side (outer side) of the right end of the guide rail 6. A through hole 35*a*, which is elongated in the scanning direction, is formed at the right end portion of the fixing portion 35. Whereas, a substantially circular shaped through hole 6*d* is formed in a portion of the guide rail 6 facing the through hole 35*a*. Further, a downstream side end (edge) surface 35*b* in the paper feeding direction, of the fixing portion 35, extending in the scanning direction makes contact with the outer peripheral surface of a shaft supporting portion 24*b* supporting the shaft 24*a* of the motor 24.

A recess 35*c* is formed in the lower surface of the fixing portion 35 at an area including the through hole 35*a*. As shown in FIGS. 7A and 7B, a plurality of engagement portions 35*d*, which are aligned at regular intervals C (for example, about 1 mm) in the scanning direction, are formed on a surface of the recess 35*c* (lower surface of the fixing portion 35) at both sides of the through hole 35*a* in the paper feeding direction. Each of the engagement portions 35*d* is recessed further than a surface of the recess 35. In each of the engagement portions 35*d*, a wall surface 35*d*1 on a right side is extended in the up-down direction; and a wall surface 35*d*2, which is extended to be inclined with respect to the scanning direction and the up-down direction so that the leftmost portion of the wall surface 35*d*2 is positioned on the lowest position, connects the upper end of the wall surface 35*d*1 (a side opposite to the surface of the recess 35*c*) and the surface of the recess 35*c*.

The engagement portions 35*d* on the upstream side of the through hole 35*a* in the paper feeding direction and the engagement portions 35*d* on the downstream side of the through hole 35*a* in the paper feeding direction are arranged to be shifted with each other in the scanning direction by C/2 (for example, about 0.5 mm) which has half the length of the interval between the engagement portions 35*d*. Accordingly, the engagement portions 35*d* are disposed on any of the upstream side and the downstream side of the through hole 35*a* in the paper feeding direction with the interval C/2 therebetween which has half the arrangement interval of each of the engagement portions 35*d* on the upstream side and the downstream side in the paper feeding direction, in the lower surface of the fixing portion 35.

A portion 36, of the pulley holder 27, which is positioned at the lower side of the guide rail 6 and is positioned at the left end portion overlaps with the abovementioned portion 33 in a plan view, and the guide rail 6 is sandwiched from an upper side and a lower side by the portion 33 and the portion 36.

Figure 4:
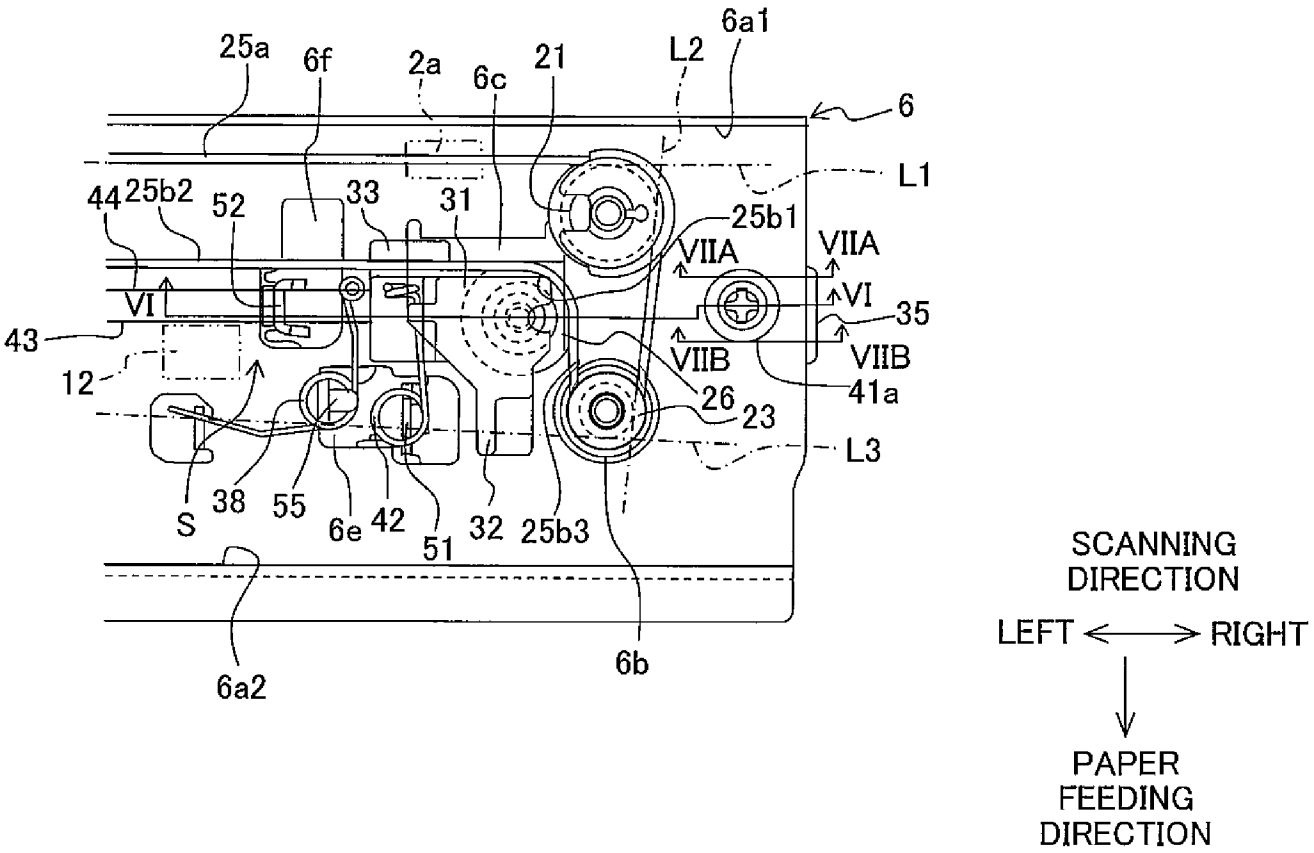
FIG. 4 is a partially enlarged view of FIG. 3.

Regarding the pulley holder 27 having the structure as described above, the protrusion 34 of the pulley holder 27 makes contact with the wall surface 6*c*1 of the through hole 6*c*, and the end surface 35*b* of the fixing portion 35 makes contact with the shaft supporting portion 24*b* of the motor 24. Accordingly, movement of the pulley holder 27 to the downstream side in the paper feeding direction is regulated. Whereas, as shown in FIG. 4, since force is exerted from the belt 25 to the tension pulley 26 bending the belt 25 and the pulley holder 27 holding the tension pulley 26 in a leftward direction and a direction toward the downstream side in the paper feeding direction, the protrusion 34 is pushed against the wall surface 6*c*1, and also, the end surface 35*b* is pushed against the outer peripheral surface of the shaft supporting portion 24*b*. Accordingly, the pulley holder 27 and the tension pulley 26 held by the pulley holder 27 are movable only in the scanning direction (an example of the first direction) along the wall surface 6*c*1.

A plate 28 (second plate) is provided at the lower side of the pulley holder 27, and the abovementioned motor 24 is provided at the lower side of the plate 28. The plate 28 is a member in a form of a substantially rectangular shaped plate made of a metallic material. The plate 28 is fixed to the guide rail 6 by a bolt which is not shown in the diagram, at a portion on the left side of a position at which a portion of the pulley holder 27 positioned on the lower side of the guide rail 6 is arranged. The guide rail 6 and the plate 28 are configured not to move relative to each other in a horizontal plane (in the second plane) extending in the scanning direction and the paper feeding direction. Further, the right end of the plate 28 is placed on the left side of the right end of the guide rail 6, and a portion of the fixing portion 35 protruding toward the right side of the guide rail 6 protrudes toward the right side of the plate 28.

Figure 5B:
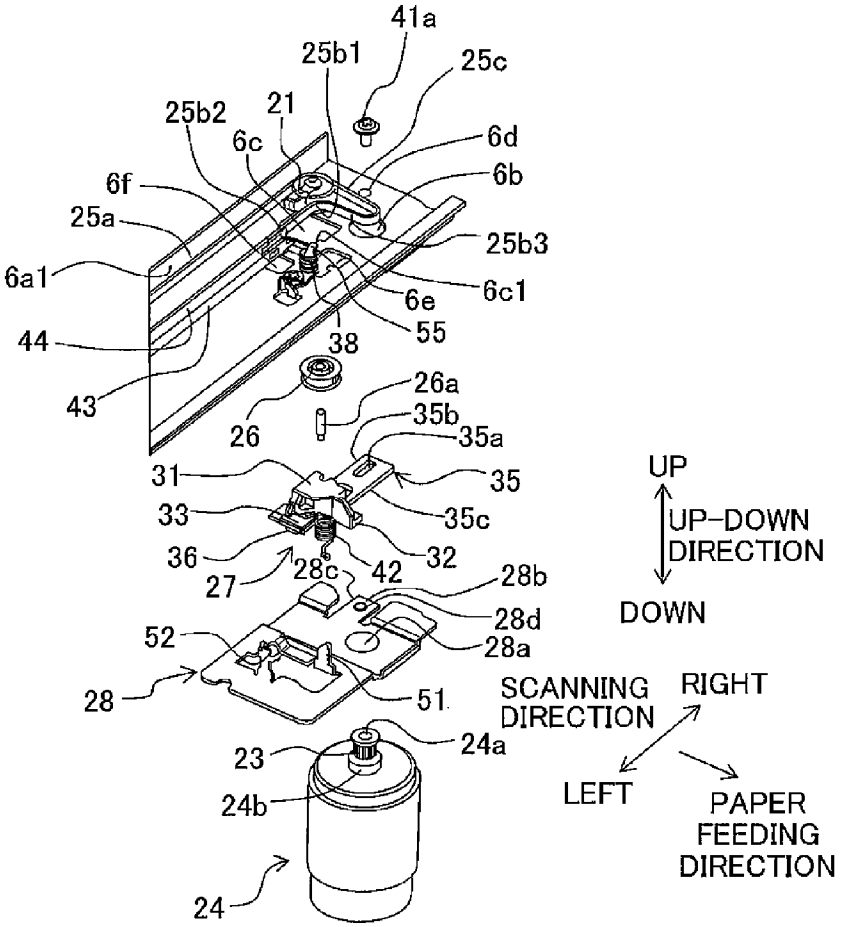
FIG. 5B is an exploded perspective view of FIG. 5A.
Figure 5A:
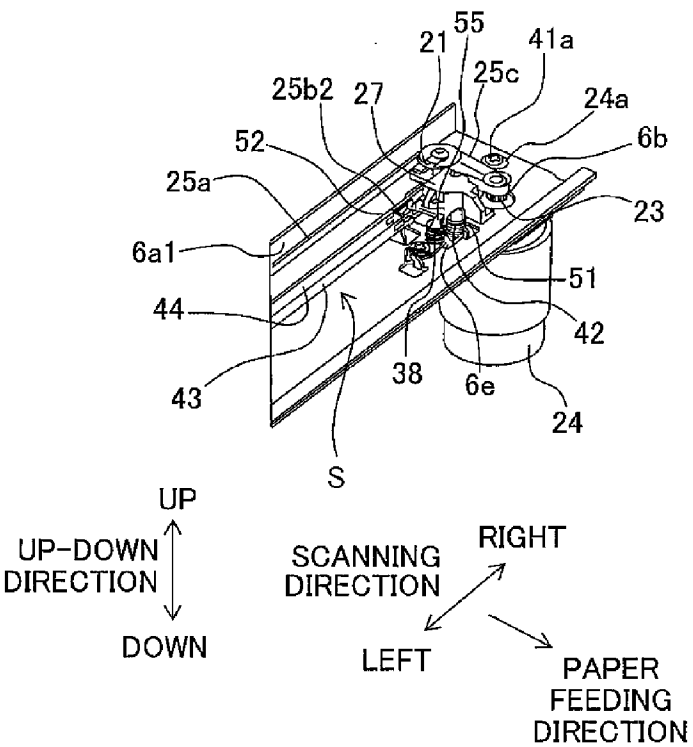
FIG. 5A is a perspective view of a portion as shown in FIG. 4.
Figure 6:
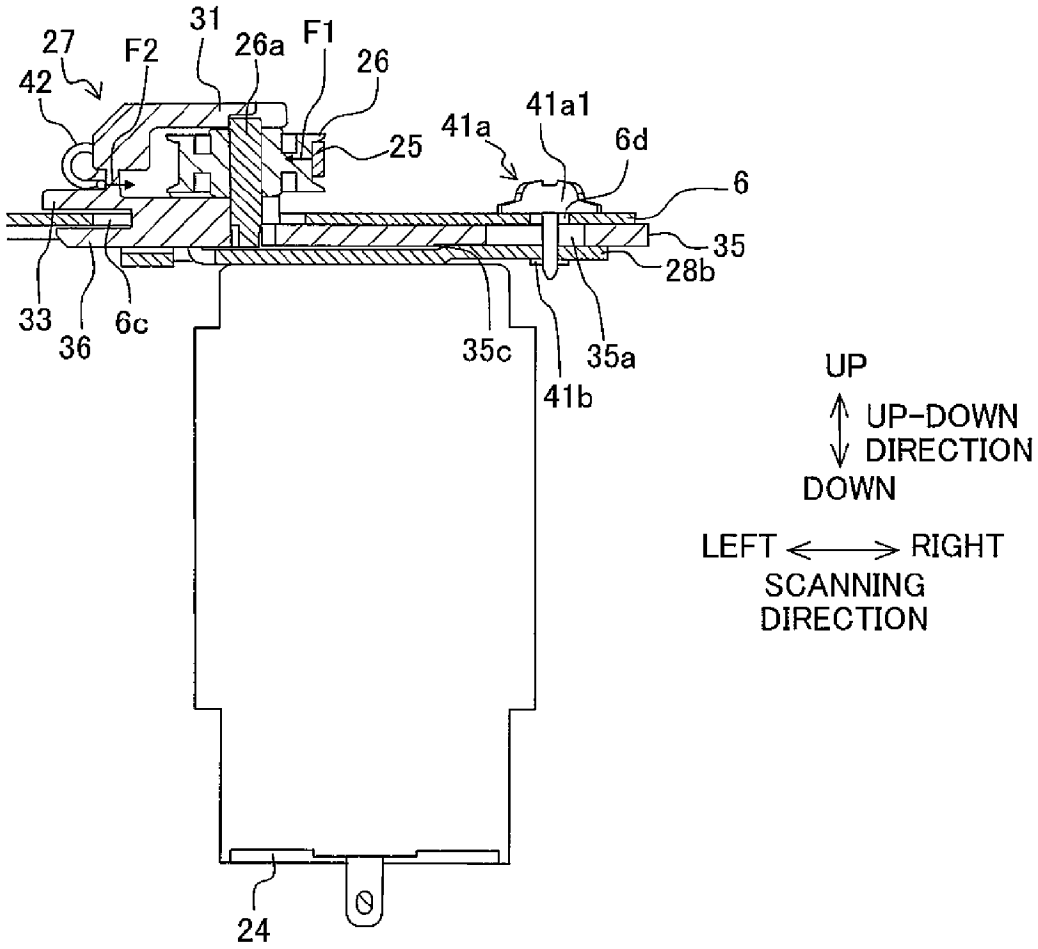
FIG. 6 is a cross-sectional view taken along a line VI-VI in FIG. 4.

As shown in FIG. 5B, a substantially circular shaped through hole 28*a* is formed in a portion of the plate 28 overlapping with the pulley 23, and the shaft supporting portion 24*b* of the motor 24 is passed through the through hole 28*a*, and is drawn to the upper side of the plate 28.

The plate 28 is provided with an attaching portion 28*b* for attaching the fixing portion 35, at the right end thereof. The attaching portion 28*b* is arranged so that the fixing portion 35 of the pulley holder 27 is sandwiched between the attaching portion 28*b* and the right end portion of the guide rail 6 in the up-down direction. A width of the attaching portion 28*b* in the paper feeding direction is narrow as whole as compared with a portion of the plate 28 on the left side in the scanning direction. Further, cutouts 28*c* are formed at a base end portion of the attaching portion 28*b* at both end portions in the paper feeding direction. By forming the cutouts 28*c* as described above, the width of the attaching portion 28*b* in the paper feeding direction is further narrowed at the base end portion at which the cutouts 28*c* are formed.

A substantially circular shaped through hole 28*d* is formed in a portion of the attaching portion 28*b* facing the through holes 35*a* and 6*d*. A bolt 41*a* is inserted through the through holes 6*d*, 35*a*, and 28*d*. The fixing portion 35 of the pulley holder 27 is fixed to the guide rail 6 and the plate 28 by the bolt 41*a* and a nut 41*b* attached to the front end portion of the bolt 41*a*, in a state of being sandwiched between the right end portion of the guide rail 6 and the attaching portion 28*b* of the plate 28. In this embodiment, a combination of the bolt 41*a* and the nut 41*b* corresponds to a fastening member according to the present teaching.

As described above, the width of the attaching portion 28*b* in the paper feeding direction is narrow as whole and the width of the base end portion of the attaching portion 28*b* in the paper feeding direction is further narrowed by forming the cutouts 28*c*. Thus, an amount of displacement of the attaching portion 28*b* with respect to force acting in the up-down direction (direction perpendicular to the second plane) is larger than that of the guide rail 6. Therefore, in a case that the fixing portion 35 is fixed to the guide rail 6 and the attaching portion 28*b* of the plate 28 by the bolt 41*a* and the nut 41*b*, the guide rail 6 is hardly deformed and the attaching portion 28*b* of the plate 28 is curved toward the guide rail 6 to deform upward. Accordingly, the fixing portion 35 of the pulley holder 27 is securely sandwiched between the right end portion of the guide rail 6 and the attaching portion 28*b* of the plate 28 to be fixed thereto.

As shown in FIG. 7A, the attaching portion 28*b* in a state of being curved is accepted in a gap, which is formed between the fixing portion 35 and the attaching portion 28*b* by the recess 35*c*, before being fixed, and the right end portion of the attaching portion 28*b* is engaged with one of the engagement portions 35*d* formed on the upstream side of the through hole 35*a* in the paper feeding direction and one of the engagement portions 35*d* formed on the downstream side of the through hole 35*a* in the paper feeding direction. Accordingly, movement of the fixed pulley holder 27 in the scanning direction is regulated.

As shown in FIG. 5B, a film fitting portion 52 and a spring fitting portion 51 extending upward of the plate 28 are provided to the plate 28 at a portion, which is positioned at the left side of the pulley holder 27, at the downstream side of the portion 25*b*2 of the belt 25 in the paper feeding direction, and at the upstream side of the shaft of the pulley 23 in the paper feeding direction (in other words, a portion positioned between the portion 25*b*2 and a plane that is parallel to the scanning direction and passes through the axis of the pulley 23). Through holes 6*e* and 6*f* are formed in portions of the guide rail 6 which overlap with the spring fitting portion 51 and the film fitting portion 52 respectively, and the spring fitting portion 51 and the film fitting portion 52 are extended up to the upper side of the guide rail 6 upon passing through the through holes 6*e* and 6*f*.

A torsion spring 42 is attached to the spring fitting portion 51. As shown in FIG. 4, the lower end portion of the torsion spring 42 is supported by the guide rail 6; and the upper end portion of the torsion spring 42 makes contact with a portion, of the pulley holder 27, which is positioned at the upper side of the guide rail 6 and is positioned at the left side and the lower side of the tension pulley 26. Accordingly, the torsion spring 42 biases or urges the pulley holder 27 in a rightward direction, in other words, in a direction of getting closer to the pulleys 21 and 23 in the scanning direction.

Here, the pulley holder 27 is fixed to the guide rail 6 and the plate 28 by the bolt 41*a* and the nut 41*b* as mentioned above, and a position of the pulley holder 27 in this situation will be described below. In a case that the pulley holder 27 and the torsion spring 42 are assembled at the time of manufacturing the printer 1, the pulley holder 27 which is movable in the scanning direction is in a state of being arranged at a position at which force F1 acting on the pulley holder 27 in the scanning direction due to the tension of the belt 25 and force F2 acting on the pulley holder 27 in the scanning direction due to the biasing force of the torsion spring 42 are balanced. Accordingly, the tension applied to the belt 25 is adjusted to a magnitude corresponding to the biasing force of the torsion spring 42. The pulley holder 27, in this state, is fixed to the lower surface of the guide rail 6 by the bolt 41*a*. Consequently, biasing force of the torsion spring 42 is fixed to biasing force at the time of assembling (so-called a fixed tension).

Since the pulley holder 27 is fixed at a position at the time of the assembling as described above, in a case that the carriage 2 is moved by driving the belt 25 to travel and that the tension of the belt 25 is changed, the pulley holder 27 is not moved in the scanning direction, unlike in a case of adopting the autotension such as Japanese Patent Application laid-open No. 2006-21423. Therefore, even when the tension of the belt 25 is small, it is possible to prevent jumping of the belt 25 (difficulty in the travel of the belt 25).

Figure 2:
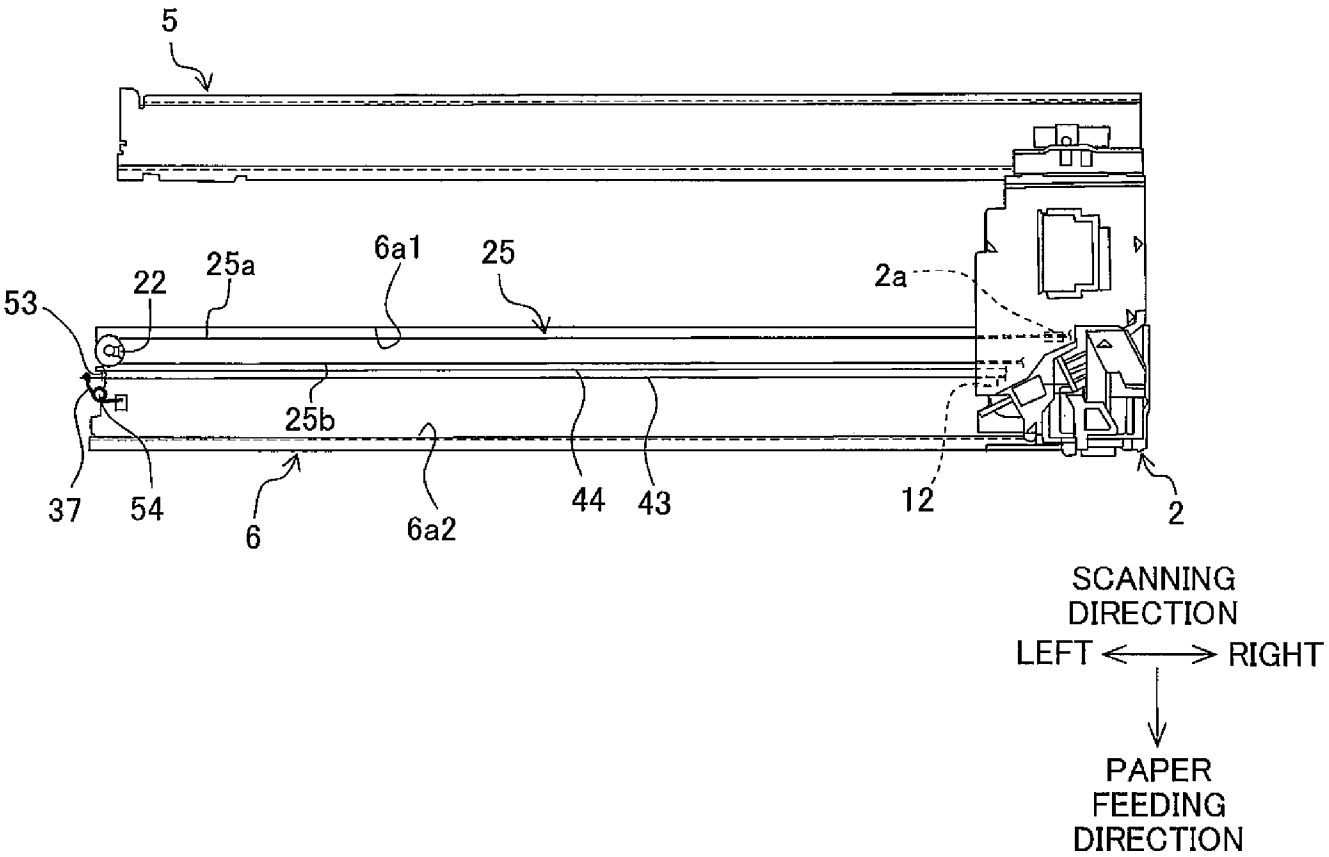
FIG. 2 is a plan view of a structure of a carriage and guide rails in FIG. 1.
Figure 3:
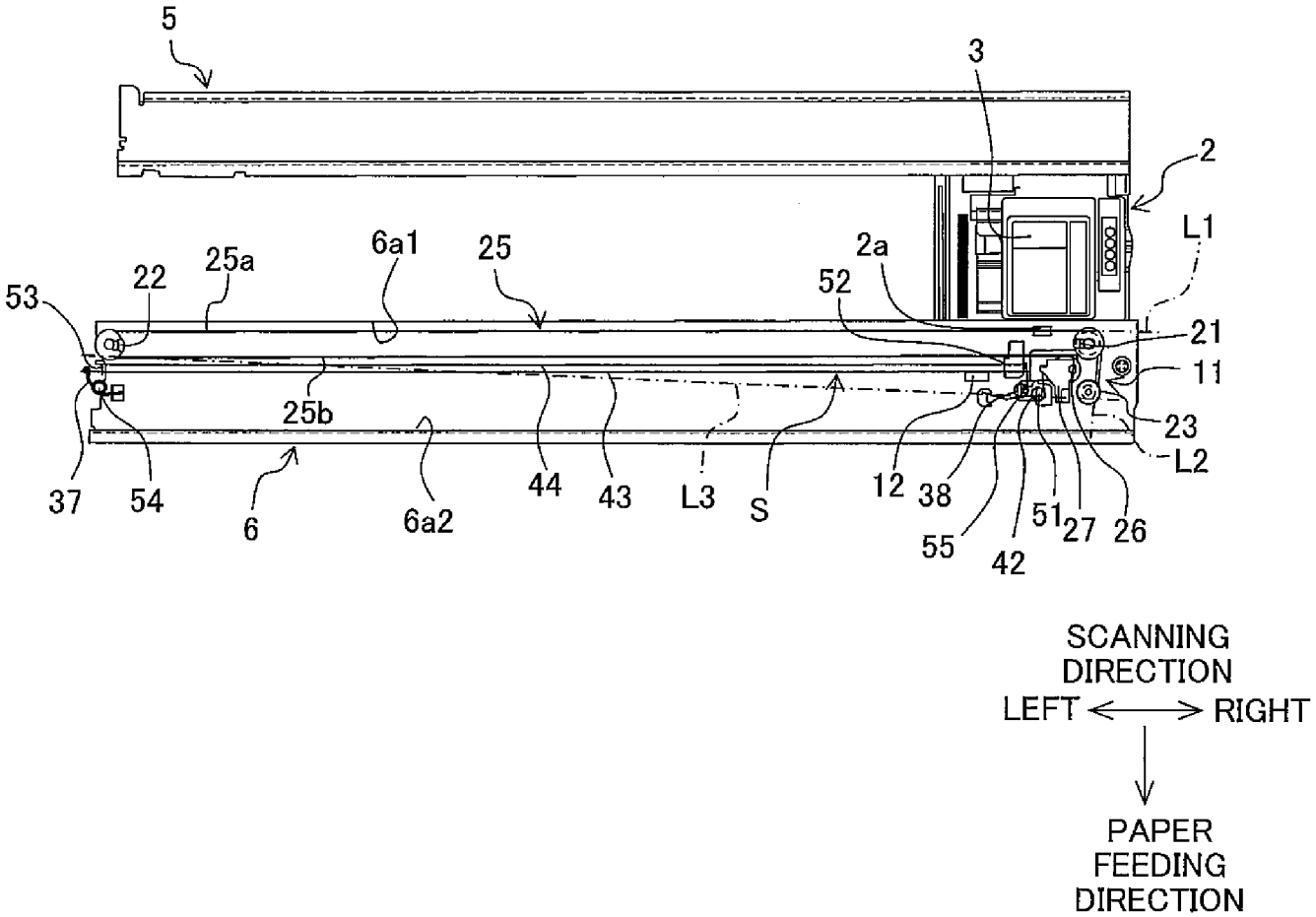
FIG. 3 is a diagram in which a portion of the carriage at an upper side of the guide rails is removed from FIG. 2.

As shown in FIGS. 2 and 3, a film fitting portion 53 is provided to the left end portion of the guide rail 6 at a portion overlapping with the film fitting portion 52 in the scanning direction. An encoder film 43 which is extended in the scanning direction is arranged between the two film fitting portions 52 and 53, and the right end portion and the left end portion of the encoder film 43 are fitted (attached) to the film fitting portions 52 and 53 respectively.

A spring fitting portion 54 is provided to the left end portion of the guide rail 6, and a torsion spring 37 is fitted to the spring fitting portion 54. The lower end portion of the torsion spring 37 is supported by the guide rail 6, and the upper end portion of the torsion spring 37 is fitted to the left end portion of the encoder film 43, thereby pulling the encoder film 43 to the left side. Accordingly, the encoder film 43 is extended in the scanning direction without being slacked.

The encoder film 43 is a film in which a plurality of slits, which are not shown in the diagram, are formed in the scanning direction. A position detection element 12 is provided to the carriage 2 at a portion facing a surface on the downstream side of the encoder film 43 in the paper feeding direction. By detecting the slits of the encoder film 43 by the position detection element 12, it is possible to detect a position of the carriage 2.

A protective film or a protection film 44 which is extended in the scanning direction is arranged between the two film fitting portions 52 and 53 at a portion positioned between the encoder film 43 and the portion 25*b*2 of the belt 25 in the paper feeding direction. The right end portion and the left end portion of the protective film 44 are attached to the film fitting portions 52 and 53 respectively.

A spring fitting portion 55 is provided on the upper surface of the guide rail 6 at a portion on the immediate left side of the spring fitting portion 51, and a torsion spring 38 is fitted to the spring fitting portion 55. The lower end portion of the torsion spring 38 is supported by the guide rail 6, and the upper end portion of the torsion spring 38 is fitted to the right end portion of the protective film 44, and thereby pulling the protective film 44 to the right side. Accordingly, the protective film 44 is extended in the scanning direction without being slacked.

According to the embodiment as described above, the fixing portion 35 of the pulley holder 27 is fixed to the guide rail 6 and the plate 28 by the bolt 41*a* and the nut 41*b* in a state of being sandwiched between the guide rail 6 and the attaching portion 28*b* of the plate 28. Thus, it is possible to prevent a position shift, of the pulley holder 27 and the tension pulley 26 held by the pulley holder 27, in a plane parallel to the scanning direction and the paper feeding direction, at the time of fixing the pulley holder 27.

To explain more elaborately, for example, assuming that the fixing portion 35 is fixed to the guide rail 6 in a state that the lower side of the fix portion 35 is not fixed by the attaching portion 28*b*, unlike in this embodiment, in a case that the fixing portion 35 is fixed to the guide rail 6 by the bolt 41*a* and the nut 41*b* as shown in 9A, force in the scanning direction is applied from the bolt 41*a* to a contact portion 35*a*1 making contact with the bolt 41*a*, of a wall surface of the through hole 35*a* of the fixing portion 35 in the paper feeding direction. The force may cause the position shift of the pulley holder 27 in the scanning direction.

Figures 9A, 9B, 9C:
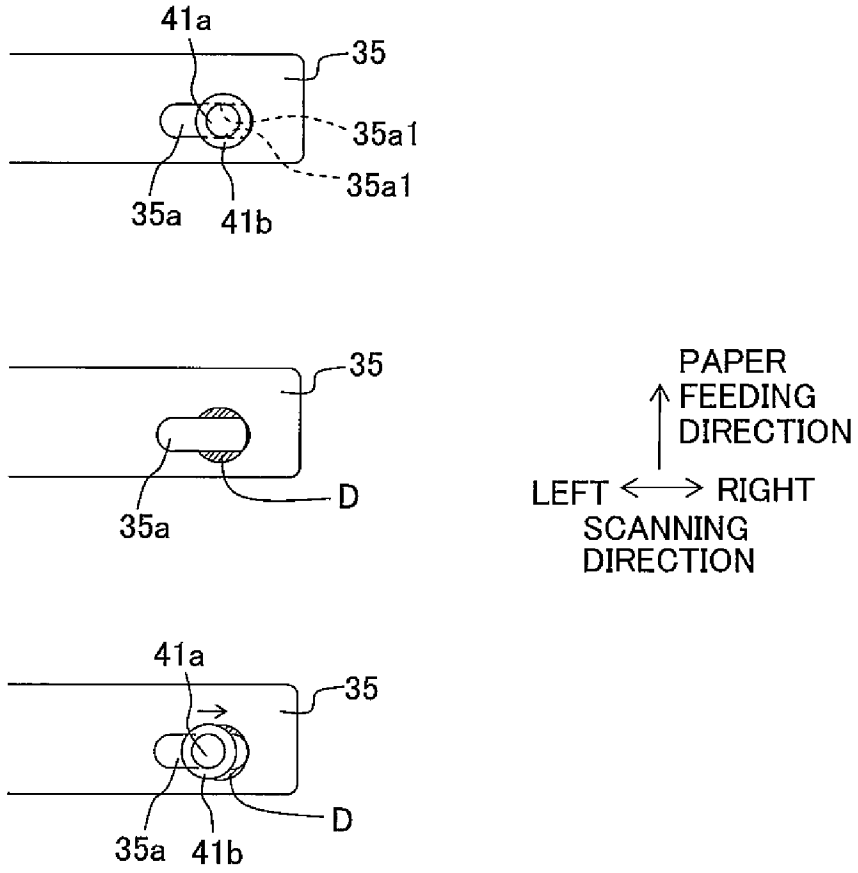
FIGS. 9A to 9C are diagrams each showing a lower surface of a fixing portion in a case that the pulley holder is fixed to the guide rails in a state that no plate is provided on the lower side of the pulley holder.

In this situation, since the lower surface of the fixing portion 35 is fastened by the nut 41*b* directly. Thus, as shown in FIG. 9B, a recess D is formed at a portion, of the lower surface of the fixing portion 35, fastened by the nut 41*b*. Therefore, in a case that the fixing by the bolt 41*a* and the nut 41*b* is released to fix the pulley holder 27 at a different position in order to readjust the tension applied to the belt 25, the nut 41*b* tries to move to a position before readjustment by being guided to the recess D as shown by an arrow in FIG. 9C. At this time, there is fear that the position shift of the fixing portion 35 in the scanning direction is caused in the recess D due to the force received from the nut 41*b*. In each of FIGS. 9B and 9C, the recess D is hatched to make it easy to distinguish from the through hole 35*a*.

In a case that the tension pulley 26 is shifted in the scanning direction due to the position shift of the pulley holder 27, the tension applied to the belt 25 is changed significantly. For example, even when the tension pulley 26 is shifted by only about 0.5 mm, the tension applied to the belt 25 is changed significantly. In this case, as shown in FIGS. 9A to 9C, since the attaching portion 28*b* is not provided, the recess 35*c* for forming the gap to accept the attaching portion 28*b* in a state of being curved and the engagement portion 35*d* with which the front end portion of the attaching portion 28*b* is engaged are not formed in the lower surface of the fixing portion 35.

On the other hand, in this embodiment, since the fixing portion 35 is sandwiched between the guide rail 6 and the attaching portion 28*b* of the plate 28, there is no force in the horizontal direction from the bolt 41*a* to the fixing portion 35. Further, the fixing portion 35 is not fastened locally by a head 41*a*1 of the bolt 41*a* and the nut 41*b*, and thus the recess D as described above is not formed in the fixing portion 35.

Therefore, in a case that the fixing portion 35 is fixed to the guide rail 6 and the attaching portion 28*b* of the plate 28, the position shift of the pulley holder 27 as described above is not caused. Accordingly, the pulley holder 27 and the tension pulley 26 are fixed at a position at which force received from the torsion spring 42 and force received from the belt 25 in the puller holder 27 are balanced in the scanning direction, thereby applying a predetermined tension to the belt 25 reliably.

Further, the width of the attaching portion 28*b* of the plate 28 in the paper feeding direction is narrow as whole, and furthermore, by forming the cutouts 28*c*, the width of the base end portion of the attaching portion 28*b* in the paper feeding direction is further narrowed. Accordingly, the amount of displacement of the attaching portion 28*b* with respect to the force in the up-down direction is larger than that of the guide rail 6. Therefore, as mentioned above, in a case that the fixing portion 35 is fixed to the guide rail 6 and the plate 28, the attaching portion 28*b* is curved toward the guide rail 6 to securely sandwich the fixing portion 35 between the guide rail 6 and the attaching portion 28*b*. Accordingly, it is possible to reliably prevent the position shift of the pulley holder 27 in the horizontal direction.

In this situation, since the guide rail 6 is hardly deformed, a positional relation between the tension pulley 26 held by the pulley holder 27 and other pulleys 21 to 23 and a positional relation between the tension pulley 26 held by the pulley holder 27 and sliding surfaces 6*b*1 and 6*b*2 are hardly changed at the time of fixing the pulley holder 27 to the guide rail 6 and the plate 28. Therefore, it is possible to apply the predetermined tension to the belt 25 reliably.

Further, in this situation, the recess 35*c* is formed in the lower surface of the fixing portion 35 and the gap is formed between the fixing portion 35 and the attaching portion 28*b* in a state before the fixing is performed. Thus, it is possible to accept the attaching portion 28*b* of the plate 28, which is curved at the time of the fixing, in this gap.

The plurality of engagement portions 35*d* aligned in the scanning direction are formed in the surface of the recess 35*c*, the front end portion of the attaching portion 28*b* in a state of being curved is engaged with one of the engagement portions 35*d*. Accordingly, the movement of the fixing portion 35 in the scanning direction is regulated and it is possible to prevent the position shift of the pulley holder 27 in the scanning direction after the fixing.

As described above, the engagement portions 35*d* are formed on the upstream side and the downstream side of the through hole 35*a* in the paper feeding direction, and movement of the fixing portion 35 in the scanning direction on the opposite sides of the through hole 35*a* in the paper feeding direction is regulated, thereby making it possible to prevent the position shift of the pulley holder 27 in the scanning direction reliably.

In this situation, the position of the fixing portion 35 may be shifted within a range in which the front end portion of the attaching portion 28*b* is movable in the engagement portion 35*d*. Since the engagement portions 35*d* (first engagement portions) on the upstream side of the through hole 35*a* in the paper feeding direction are arranged to be shifted by C/2, which has approximately half the length of the interval C between the engagement portions 35*d*, with respect to the engagement portions 35*d* (second engagement portions) on the downstream side of the through hole 35*a* in the paper feeding direction, it is possible to make the range of the position shift of the fixing portion 35 in the scanning direction smaller than the interval between the engagement portions 35*d*.

To explain more elaborately, for example, assuming that each interval C between the engagement portions 35*d* on the upstream side and downstream side of the through hole 35*a* in the paper feeding direction is 1 mm, and that the engagement portions 35*d* on the upstream side of the through hole 35*a* in the paper feeding direction and the engagement portions 35*d* on the downstream side of the through hole 35*a* in the paper feeding direction are arranged at the same position in the scanning direction, unlike in this embodiment, the position of the fixing portion 35 may be shifted in the scanning direction within a range of not more than 1 mm. On the other hand, in this embodiment, assuming that the engagement portions 35*d* on the upstream side of the through hole 35*a* in the paper feeding direction and the engagement portions 35*d* on the downstream side of the through hole 35*a* in the paper feeding direction are arranged to be shifted with each other in the scanning direction by 0.5 mm, the position of the fixing portion 35 may be shifted only in a range of not more than 0.5 mm.

In this embodiment, since the plane (first plane) on which the axes of the pulley 21 to 23 are arranged and the plane (second plane) perpendicular to a stacking direction of the fixing portion 35 and the plate 28 are both horizontal and are parallel to each other, it is possible to make the height of the printer 1 lower as compared with a case in which the two planes intersect with each other.

Next, modified embodiments in which various modifications are made in the embodiment will be described below. However, explanation of components having the structures similar to those of the above-described embodiment will be omitted when appropriate.

In the above embodiment, the torsion spring 42 is left in a state of being attached after the fixing portion 35 is fixed to the guide rail 6 and the plate 28. The torsion spring 42, however, may be removed after the fixing portion 35 is fixed to the guide rail 6 and the plate 28. Alternately, the pulley holder 27 may be fixed to the guide rail 6 and the plate 28 in a state of being positionally adjusted with respect to a position at which the predetermined tension is applied to the belt 25 by a special fixture and the like, without providing the torsion spring 42.

In the above embodiment, the plurality of engagement portions 35*d* are provided on the opposite sides of the through hole 35*a* in the paper feeding direction, respectively, and the engagement portions 35*d* on the upstream side of the through hole 35*a* in the paper feeding direction and the engagement portions 35*d* on the downstream side of the through hole 35*a* in the paper feeding direction are arranged to be shifted with each other in the scanning direction. However, the present teaching is not limited thereto. The engagement portions 35*d* on the upstream side of the through hole 35*a* in the paper feeding direction and the engagement portions 35*d* on the downstream side of the through hole 35*a* in the paper feeding direction may be arranged at the same position in the scanning direction.

Further, the present teaching is not limited to the structure in which the plurality of engagement portions 35*d* are provided on the opposite sides of the through hole 35*a* in the paper feeding direction, respectively. The plurality of engagement portions 35*d* may be provided on any one of the upstream side and the downstream side of the through hole 35*a* in the paper feeding direction. Alternately, the engagement portions 35*d* may be formed at a portion, of the lower surface of the fixing portion 35, other than the upstream side and the downstream side of the through hole 35*a* in the paper feeding direction, such as a portion of the lower surface of the fixing portion 35 on the right side of the through hole 35*a* in the scanning direction.

The engagement portions 35*d* may not be formed on the lower surface of the fixing portion 35. As described above, the fixing portion 35 is securely sandwiched between the guide rail 6 and the attaching portion 28*b* by curving the attaching portion 28*b* of the plate 28 toward the guide rail 6. Thus, even when the engagement portions 35*d* are not provided, the position of the fixing portion 35 is hardly shifted in the scanning direction after the fixing. In this case, the fixing portion 35 is not required to protrude toward the outer side (right side) of the attaching portion 28*b* of the plate 28 in the scanning direction.

In the above embodiment, by forming the recess 35*c* in the lower surface of the fixing portion 35, the gap for accepting the attaching portion 28*b*, which is curved at the time of the fixing, is formed between the fixing portion 35 and the attaching portion 28*b* in a state before the fixing is performed. The recess 35*c*, however, may not be formed.

In the above embodiment, the fixing portion 35 is fixed to the guide rail 6 and the plate 28 by the bolt 41*a*, which is extended to pass through the guide rail 6, the fixing portion 35, and the attaching portion 28*b* of the plate 28, and the nut 41*b* attached to the bolt 41*a*. Corresponding to this, the through hole 35*a* elongated in the scanning direction is formed in the fixing portion 35 in order that the pulley holder 27 can be fixed to the guide rail 6 and the plate 28 at each position in the scanning direction. The present teaching, however, is not limited thereto.

For example, the fixing portion 35 may be fixed to the guide rail 6 and the attaching portion 28*b* of the plate 28 by a rivet which is extended to pass through the guide rail 6, the fixing portion 35, and the attaching portion 28*b* of the plate 28. Alternately, the fixing portion 35 may be fixed to the guide rail 6 and the attaching portion 28*b* of the plate 28 by pressing the guide rail 6, the fixing portion 35, and the attaching portion 28*b* of the plate 28, those of which are stacked to one another, from above and below, by a plate spring and the like, without providing through holes 6*d*, 35*a*, 28*d*, etc. In the above cases, the rivet and the plate spring correspond to the fastening member according to the present teaching.

In the above embodiment, the axes of the pulleys 21 to 23 are fixed to the upper surface of the guide rail 6, and the fixing portion 35 of the pulley holder 27 is sandwiched between the lower surface of the guide rail 6 and the upper surface of the attaching portion 28*b* of the plate 28. Thereby, the plane (first plane) to which the axes of the pulleys 21 to 23 are fixed and the plane (second plane) which is perpendicular to the stacking direction of the guide rail 6, the fixing portion 35, and the attaching portion 28*b* are parallel to each other. The present teaching, however, is not limited thereto.

For example, in a case that the attaching portion 28*b* is fixed to a plane other than the upper surface and the lower surface of the guide rail 6, the plane may not be parallel to the plane to which the axes of the pulleys 21 to 23 are fixed. That is, the first plane and the second plane may not be parallel to each other.

In the above embodiment, the fixing portion 35 is sandwiched between the plate 28 and the guide rail 6 in which the sliding surfaces 6*b*1 and 6*b*2 and the axes of the pulleys 21 to 23 are provided. The present teaching, however, is not limited thereto. For example, the fixing portion 35 may be sandwiched between two plates other than the guide rail 6 and the plate 28. Also in this case, provided that the two plates are configured not to move relative to each other in a direction parallel to the plane (second plane) perpendicular to the stacking direction thereof, the position of the pulley holder 27 does not shift in the second plane with respect to the two plates, at the time of fixing the fixing portion 35 to the two plates. Therefore, provided that it is configured such that a positional relation between one of the two plates and the sliding surfaces 6*b*1 and 6*b*2 and a positional relation between one of the two plates and the pulleys 21 to 23 are maintained before and after the fixing, it is possible to apply the predetermined tension to the belt 25 reliably.

In the above embodiment, since the pulley holder 27 is movable only in the scanning direction in the state before the fixing is performed, the tension applied to the belt 25 is adjustable. The present teaching, however, is not limited thereto. For example, the pulley holder 27 may be movable in another direction which is parallel to the upper surface of the guide rail 6 on which the axes of the pulleys 21 to 23 are provided, and thereby making it possible to adjust the tension applied to the belt 25.

In the above embodiment, the width of the attaching portion 28*b* in the paper feeding direction is narrow as whole, and further, by forming the cutouts 28*c*, the width of the base end portion of the attaching portion 28*b* in the paper feeding direction is further narrowed. Thus, the amount of displacement of the attaching portion 28*b* with respect to the force in the up-down direction is large and thereby the attaching portion 28*b* is more likely to be curved at the time of the fixing. The present teaching, however, is not limited thereto. For example, it is also allowable that the attaching portion 28*b* is more likely to be curved by making a thickness of the attaching portion 28*b* thinner than the thickness of the guide rail 6 and/or by constructing the plate 28 by a material of which Young's modulus is lower than that of the guide rail 6.

In the above embodiment, by fixing the plate 28 to the guide rail 6 by the bolt, which is not shown in the diagram, at a portion other than the attaching portion 28*b*, the guide rail 6 and the plate 28 are configured not move relative to each other in the direction parallel to the plane (second plane) perpendicular to the stacking direction of the guide rail 6, the plate 28, and the fixing portion 35. The present teaching, however, is not limited thereto. For example, the guide rail 6 and the plate 28 may be configured not move relative to each other in the second plane by forming the guide rail 6 and the plate 28 in an integrated manner by one member.

In the above embodiment, by supporting the tension pulley 26 pressed against the surface on the outer side of the belt 25 by the pulley holder 27, the tension pulley 26 and the pulley holder 27 are movable in the scanning direction in the state before the fixing is performed. The present teaching, however, is not limited thereto. For example, by supporting any of the pulleys 21 to 23, around which the belt 25 is put to make contact with the circumference of each of the pulley 21 to 23, by the pulley holder 27, any of the pulleys 21 to 23 and the pulley holder 27 are movable in the scanning direction in the state before the fixing is performed. Further, the present teaching is not limited to the structure in which the belt 25 is put around four pulleys 21 to 23, 26. For example, the following structure is also allowable. That is, the belt 25 is put around only the first pulley 21 and the second pulley 22, and any one of the first pulley 21 and the second pulley 22 is supported by the pulley holder.

In the abovementioned description, an example in which the present teaching is applied to a printer which carries out printing by jetting an ink has been explained. However, without restricting to such an application, it is also possible to apply the present teaching to a liquid jetting apparatus other than a printer which jets a liquid other than the ink.

What is claimed is:

1. A liquid jetting apparatus configured to jet a liquid, comprising:

a liquid jetting head configured to jet the liquid;

a carriage configured to carry the liquid jetting head and to move in a predetermined scanning direction;

a plurality of pulleys arranged on a predetermined first plane parallel to the scanning direction, each having an axis extending perpendicular to the first plane, and including at least a first pulley and a second pulley which is arranged to be separated from the first pulley in the scanning direction such that at least one of two external common tangents with the first pulley and the second pulley is parallel to the scanning direction;

an endless belt put around the plurality of pulleys to make contact with a circumference of each of the first pulley and the second pulley and, connected to the carriage at a portion of the endless belt positioned on the external common tangent parallel to the scanning direction, which is one of the two external common tangents with the first pulley and the second pulley;

a pulley holder having a fixing portion, holding a tension adjusting pulley which is included in the plurality of pulleys and which adjusts a tension applied to the belt, and configured to be movable along the first plane together with the tension adjusting pulley;

two plates configured to sandwich the fixing portion therebetween; and a fastening member configured to fix the fixing portion to the two plates, wherein the two plates are configured not to move relative to each other in a direction parallel to a second plane which is perpendicular to a stacking direction of the two plates and the fixing portion; and the fixing portion is fixed to the two plates in a state that the pulley holder is arranged at a position at which a predetermined tension is applied to the belt;

wherein the two plates are constructed of:

a first plate in which a sliding surface, which is parallel to the scanning direction and guides the carriage in the scanning direction by sliding the carriage thereon, is provided and to which axes of another pulleys other than the tension adjusting pulley among the plurality of pulleys are fixed; and a second plate having a displacement amount, with respect to a force acting in a direction perpendicular to the second plane, which is greater than that of the first plate, and the second plate is curved toward the first plate due to a fastening force of the fastening member, such that the second plate is displaced in the direction perpendicular to the second plane with respect to the sliding surface and the axes of the another pulleys.

2. The liquid jetting apparatus according to claim 1, wherein the first plane is parallel to the second plane.

3. The liquid jetting apparatus according to claim 1, wherein on a surface of the fixing portion facing the second plate, a recess is formed at a portion including an area fastened by the fastening member.

4. The liquid jetting apparatus according to claim 1, wherein the pulley holder is configured to move in a predetermined first direction parallel to the first plane and the fixing portion protrudes to an outside of the second plate in the first direction;

a plurality of engagement portions aligned in the first direction are formed, on a surface of the fixing portion facing the second plate, at an end portion of the fixing portion in the first direction including a portion of the fixing portion protruding to the outside of the second plate; and an end portion of the second plate in the first direction, which is deformed by being curved toward the first plate, is engaged with any of the plurality of engagement portions, and thereby regulating movement of the pulley holder in the first direction.

5. The liquid jetting apparatus according to claim 4, wherein the fastening member penetrates the first plate, the fixing portion, and the second plate; and a through hole elongated in the first direction, through which the fastening member penetrates, is formed in the fixing portion.

6. The liquid jetting apparatus according to claim 5, wherein the plurality of engagement portions are arranged in a second direction perpendicular to the first direction such that the plurality of engagement portions sandwich the through hole therebetween.

7. The liquid jetting apparatus according to claim 1, further comprising a biasing member configured to bias the pulley holder in a direction in which the tension adjusting pulley is pressed to the belt.

8. The liquid jetting apparatus according to claim 1, wherein the plurality of pulleys further include: a third pulley, which is arranged at a position at which an external common tangent with the first pulley and the third pulley intersects the scanning direction, an outer circumference of which makes contact with the belt, and which functions as a driving pulley connected to a motor; and a fourth pulley which is pressed to an outer surface of the belt between the second pulley and the third pulley, and functions as the tension adjusting pulley.

9. The liquid jetting apparatus according to claim 1, wherein the two plates are formed in an integrated manner.

10. The liquid jetting apparatus according to claim 4, wherein an attaching portion, which protrudes in the first direction from the end portion of the second plate in the first direction and to which the fixing portion is attached, is provided at the end portion of the second plate in the first direction, and cutouts are formed at a based end portion of the attaching portion on both sides in a second direction perpendicular to the first direction.

11. The liquid jetting apparatus according to claim 1, wherein the second plate is formed of a material of which Young's modulus is lower than that of the first plate.

12. The liquid jetting apparatus according to claim 10, wherein a thickness of the attaching portion is thinner than a thickness of the first plate.

13. The liquid jetting apparatus according to claim 6, wherein the plurality of engagement portions include a plurality of first engagement portions arranged with a predetermined interval therebetween on one side in the second direction with respect to the through hole and a plurality of second engagement portions arranged with the predetermined interval therebetween on the other side in the second direction with respect to the through hole, and the first engagement portions are arranged to be shifted in the first direction by a length, which is a half of the predetermined interval, with respect to the second engagement portions.

* * * * *